United States Patent [19]

Iwata

[11] 4,293,860

[45] Oct. 6, 1981

[54] ANTENNA ALARM ASSEMBLY FOR VEHICLE

[75] Inventor: Keisuke Iwata, Tokyo, Japan

[73] Assignee: Iwata Electric Co., Ltd., Tokyo, Japan

[21] Appl. No.: 177,842

[22] Filed: Aug. 14, 1980

[30] Foreign Application Priority Data

Jan. 16, 1980 [JP] Japan ..... 55-3409[U]

[51] Int. Cl.[3] ..... H01Q 1/32

[52] U.S. Cl. ..... 343/715; 343/894; 340/65

[58] Field of Search ..... 343/715, 849, 720; 340/63, 64, 65, 568, 567

[56] References Cited

U.S. PATENT DOCUMENTS 4,137,521 1/1979 Martinez ..... 343/894

*Primary Examiner*—Eli Lieberman

*Attorney, Agent, or Firm*—Robert E. Burns; Emmanuel J. Lobato; Bruce L. Adams

[57] ABSTRACT

An antenna assembly for vehicle radio transceiver which is detachably mounted on the car body of an automobile, for example. The assembly includes a rod-shaped antenna, a hollow casing which supports the lower end of the antenna, a permanent magnet for securing the casing to the car body by magnetic attraction, a vibration detector which electrically detects any vibration applied to the casing, and an alarm circuit which operates to produce an alarm in response to detection of vibration applied to the casing or the car body. The vibration detector includes a printed circuit board which is placed on the bottomplate of the casing and which is formed with a first and a second electrode each including a plurality of interdigitated fingers and connected across a d.c. power supply circuit. The vibration detector also includes a conductive spherical body which is placed on the printed circuit board in a rollable manner. When the spherical body moves over the printed circuit board in response to vibration applied to the casing, the circuit connection across the power supply is repeatedly turned on and off to produce a pulse signal, which operates the alarm circuit.

4 Claims, 5 Drawing Figures

ANTENNA ALARM ASSEMBLY FOR VEHICLE

FIELD OF THE INVENTION

The invention relates to an antenna assembly for vehicle radio transceiver, and more particularly, to such antenna assembly which is provided with an alarm to protect the antenna mounted on a vehicle from theft.

Radio transceivers are extensively used on vehicles to permit a radio communication for purpose of amateur communication or business purposes. An antenna associated with such radio transceiver is mounted on the top of a car body in upright manner for efficient reception and transmission of an electromagnetic wave. This results in the likelihood that the antenna may be broken by mischief or stolen when the vehicle is parked.

DESCRIPTION OF THE PRIOR ART

Attempts have been made to provide an antenna which is detachable from a vehicle so that it may be dismounted and contained inside the car when the vehicle is parked or to mount the antenna on an unaccessible central area on the roof of the vehicle in order to protect the antenna from mischief or theft whenever the vehicle is unattended. However, when the antenna is mounted centrally on the roof of the vehicle, some water-proof means must be provided to prevent the leakage of rain water or the like through the fixture used to mount the antenna into the interior of the vehicle. In addition, a cable wire which interconnects the antenna with a transceiver located within the vehicle must be exposed outside the car body over a relatively long length. On the other hand, when a fixture is used to mount the antenna on the vehicle in a detachable manner, the fixture must be disassembled each time the vehicle is parked, and must be replaced whenever the transceiver is to be used, resulting in a troublesome operation. An additional part is required such as the fixture and/or connector which connects the antenna with the cable wire, resulting in an increased cost.

SUMMARY OF THE INVENTION

It is an object of the invention to provide an antenna assembly for vehicle radio transceiver which can be easily mounted on or dismounted from a car body and which produces an audible alarm whenever any oscillation is applied to the antenna.

It is another object of the invention to provide an antenna assembly for vehicle radio transceiver which produces an audible alarm when a cable wire which interconnects the antenna assembly with a radio transceiver located within the vehicle is cut as by a knife.

In accordance with the invention, there is provided an antenna assembly for vehicle radio transceiver comprising a rod-shaped antenna, a casing including a bottomplate and a cover member located on the bottomplate to define an internal space, the casing supporting the lower end of the antenna, a permanent magnet disposed within the casing for securing the casing to the body of the vehicle by magnetic attraction, a vibration detector responsive to any vibration applied to the casing and providing an electrical signal, and an alarm circuit responsive to the electrical signal to produce an alarm. The vibration detector includes a d.c. power supply circuit, a printed circuit board placed on the bottomplate of the casing and carrying an array of interdigitated first and second finger-shaped electrode connected to one and the other terminal of the d.c. power supply circuit, and a conductive spherical body placed on the printed circuit board so as to be rollable thereon, the spherical body having a diameter which is sufficient to provide an electrical interconnection between the first and the second electrodes whenever it is located between adjacent fingers of the first and second electrodes. When the spherical body moves over the printed circuit board in response to vibration applied to the casing, the d.c. power supply circuit is repeatedly turned on and off to produce a pulse signal, which is transmitted through a conductor which provides an interconnection between the antenna and the transceiver, to the alarm circuit, thus causing it to produce an audible alarm.

In a preferred embodiment of the invention, the casing is cylindrical in configuration and has a conical top. The bottomplate of the casing is formed by a conductive metal on which a ring-shaped magnet is mounted with an insulating sheet interposed therebetween. In a region defined inside the magnet, a plurality of radially extending finger-shaped electrodes are printed on the insulating sheet, with alternate electrode fingers being connected to one terminal and the remaining electrode fingers connected to the other terminal of the d.c. power supply circuit. The fingers connected to said one terminal are connected to the transceiver and to the alarm circuit through one of conductors of a coaxial cable, together with the antenna. The other conductor of the coaxial cable is connected to the casing, whereby it is connected to the ground through the car body. When such cylindrical casing is employed, the magnitude of air resistance which the casing experiences when the vehicle is running can be reduced, allowing the antenna assembly to be reliably secured to the car body with the magnet alone. The use of the magnet permits its mounting and dismounting in a facilitated manner without causing any damage to the car body. The connection of the coaxial cable in a manner mentioned above produces a short-circuiting across the pair of conductors at the moment it is cut off with a knife, and the resulting signal indicative of the short-circuiting may be utilized to operate the alarm circuit, thus effectively producing an audible alarm whenever the cable is cut off for purpose of theft.

The vibration detector used in the antenna assembly of the invention also operates when the vehicle on which it is mounted experiences oscillations, thus effectively serving as means to prevent theft of the vehicle when it is parked.

DESCRIPTION OF PREFERRED EMBODIMENT

Figure 1:
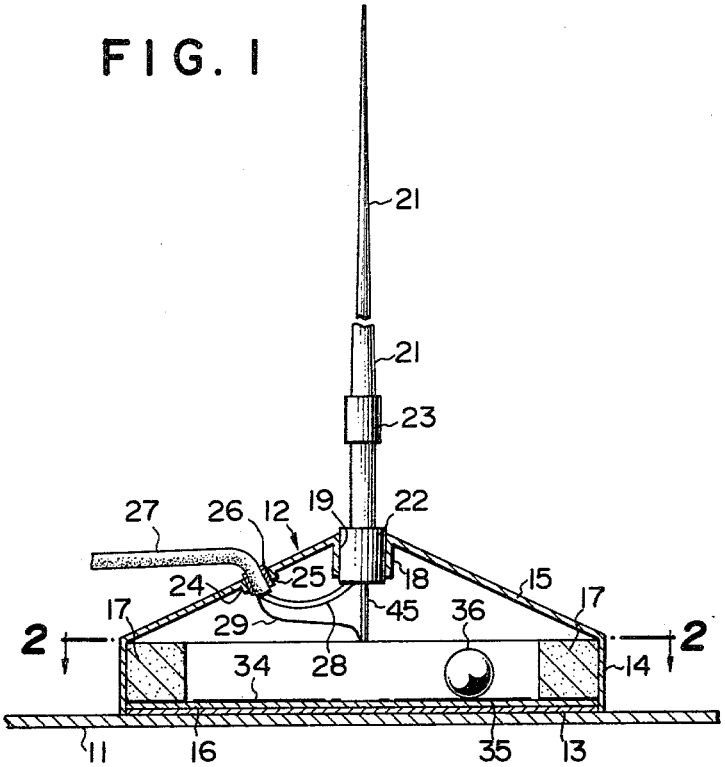
FIG. 1 is a side elevation, partly in longitudinal section, of an antenna assembly for vehicle radio transceiver according to one embodiment of the invention.
Figure 2:
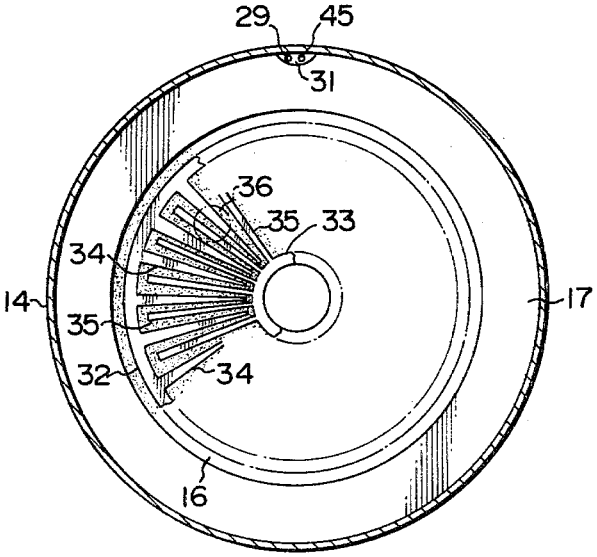
FIG. 2 is a plan view as viewed in a direction indicated by the line 2—2 shown in FIG. 1.

Referring to FIGS. 1 and 2, there is shown an antenna assembly according to the invention which may be mounted on a car body, for example, a roof 11 thereof. The assembly includes a casing 12 formed by a circular bottomplate 13, a cylindrical sidewall 14 and a conical top cover 15. The bottomplate 13 is formed of a conductive material, and a printed circuit substrate 16 is mounted thereon. A cylindrical or ring-shaped permanent magnet 17 is mounted along the periphery of the bottomplate 13, and has a height which is slightly less than the height of the sidewall 14. The top cover 15 is centrally formed with a mounting hole 19 which is defined by a depending piece 18. A support member 22 which supports the lower end of a rod-shaped antenna 21 is fitted into and secured in the mounting hole 19. The support member 22 maintains the rod-shaped antenna 21 in its upright position, and internally houses an antenna circuit (not shown). A case 23 is mounted on the lower portion of the antenna 21, and houses a loading coil (not shown) which increases the effective electrical length of the antenna. The top cover 15 is also formed with another mounting hole 25, defined by a depending piece 24, and in which a holding ring 26 is fitted and secured therein. A coaxial cable 27 which provides a common conductor for the output from the antenna circuit and the output from a vibration detector, to be described later, is fitted into the ring 26 to be retained therein. The common conductor comprises the core conductor 28 of the cable 27 while the enclosure is connected to a lead wire 29 which is in turn passed through a notch 31 formed in the periphery of the permanent magnet to be connected to the bottomplate 13.

In a region surrounded by the permanent magnet 17, the printed circuit board 16 is printed with an outer ring-shaped conductor 32 of a diameter less than the internal diameter of the permanent magnet 17, an inner ring-shaped conductor 33 which is centrally located on the printed circuit substrate 16, a first electrode including a plurality of radially extending fingers 34 having their one end connected to the outer conductor 32, and a second electrode including a second plurality of radially extending fingers 35 having their one end connected to the inner conductor 33. The fingers 34, 35 are interdigitated in alternate fashion and are spaced apart from each other. A non-magnetic conductive ball 36 is placed on the substrate 16 so as to be freely rotatable. The ball 36 has a diameter which is sufficient to provide an electrical interconnection between the adjacent fingers of the both electrodes. The ball 36 may be formed of a solid, non-magnetic and conductive metal, or may be formed of a synthetic resin material which has its peripheral surface coated with a non-magnetic, conductive metal or conductive synthetic resin. The first and second electrodes and the ball 36 constitute together a vibration detector.

Figure 3:
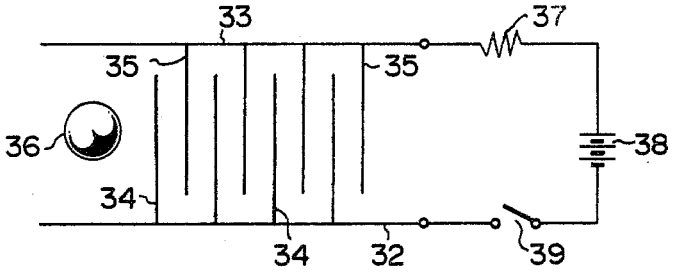
FIG. 3 is a circuit diagram of the vibration detector used in the arrangement of FIG. 1.

Referring to FIG. 3, the outer and the inner conductor 32, 33 of the vibration detector are electrically connected with a power supply 38. Specifically, the inner conductor 33 is connected through a resistor 37 with one terminal of the d.c. supply 38 while the outer conductor 32 is connected through a power switch 39 with the other terminal of the supply 38. When the ball 36 rolls on the substrate 16 to provide an electrical interconnection between the adjacent fingers of the electrodes 34, 35 or provide an electrical interconnection between the electrode 34 and the inner conductor 33 or between the electrode 35 and the outer conductor 32, a pulse-shaped voltage change is developed across the resistor 37 as shown at P in FIG. 4.

Figure 5:
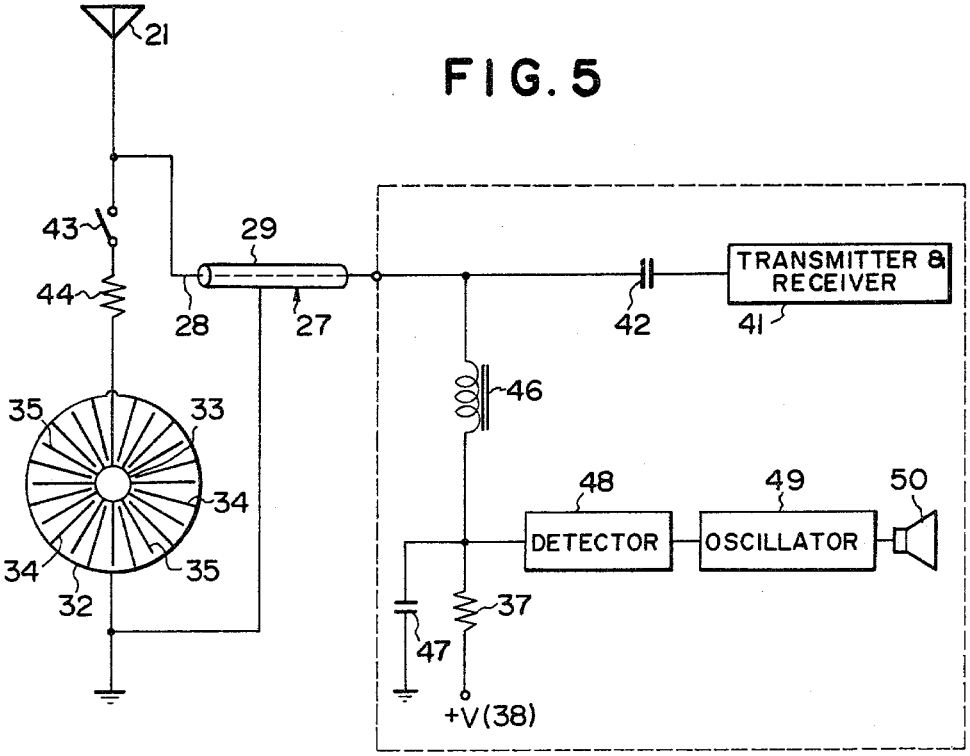
FIG. 5 is a circuit diagram of one form of an electrical circuit of the antenna assembly according to the invention.

FIG. 5 shows the electrical circuit of the antenna assembly. A vehicle radio transceiver 41 is connected to the core conductor 28 of the coaxial cable 27 through a capacitor 42 which cuts a d.c. component off. The core conductor 28 is connected to the antenna 21 and to one end of a key switch 43. The key switch 43 is used to provide a keying operation and is contained in the support member 22. A key inlet (not shown) extends through the top cover 15 into the support member 22. The other end of the key switch 43 is connected through a resistor 44 to the inner conductor 33. A lead wire 45 which interconnects the resistor 44 and the inner conductor 33 extends through the notch 31 formed in the permanent magnet 71, as shown in FIG. 2. The resistor 44 is contained within the support 22. The resistor 44 has a high resistance to prevent the short-circuiting across the both electrodes 34, 35 by the ball 36 from influencing upon the RF carrier of the radio transceiver. The core conductor of the coaxial cable 27 is also connected through a series combination of a choke coil 46 and the resistor 37 to the positive terminal of the d.c. supply 38 shown in FIG. 3. In this manner, a positive d.c. voltage is applied to the inner conductor 33. On the other hand, the outer electrode 32 is connected to the ground together with the enclosure 29 of the coaxial cable 27. Hence, a negative d.c. voltage is applied to the outer conductor 32. The junction between the choke coil 46 and the resistor 37 is connected with one end of a capacitor 47 and also with the input of a detector 48 which operates to detect the presence of a pulse P. The other end of the capacitor 47 is connected to the ground, and the combination of the choke coil 46 and the capacitor 47 forms a low pass filter. The detector 48 detects a change in the voltage across the resistor 37 to operate an oscillator 49, which then energizes a klaxon of the vehicle or an independent loudspeaker 50. Components such as the radio transceiver 41 and the detector 48 which are shown within a broken line block in FIG. 5 are located within the vehicle.

When running the vehicle, the key switch 43 or the power switch 39 mounted inside the vehicle is initially turned off, thereby turning the vibration detector off. A high frequency radio signal from the vehicle radio transceiver 41 is fed through the capacitor 42 and the core conductor 28 of the coaxial cable 27 to the rod-shaped antenna 21, which radiates it into the space. Obviously, the flow of the signal is just the opposite when receiving the electromagnetic wave. When the vehicle is parked, and the driver is leaving it, the power switch 39 is initially turned on, and after getting out of the vehicle, the key switch 43 is turned on. Then, the d.c. voltage is applied to the second electrode 35 from the d.c. power supply 38 through a path including the resistor 37, choke coil 46, the core conductor of the coaxial cable 27, the key switch 43, the resistor 44 and the inner conductor 33. When the ball 36 is situated to interconnect the first and the second electrode 34, 35, a voltage of a high level will be developed across the resistor 37. Alternatively, when the ball 36 does not interconnect the first and the second electrode 34, 35, the voltage developed across the resistor 37 will be of a low level. If the radio transceiver 41 is left operating when the vehicle is parked, the low pass filter formed by the choke coil 46 and the capacitor 47 prevents the radio signal from being passed to the d.c. supply 38 and the detector 48 while allowing the voltage from the supply 38 to be applied to the second electrode 35.

Figure 4:
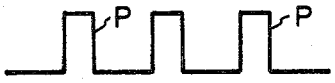
FIG. 4 is a waveform diagram illustrating a pulse signal which may be produced by the vibration detector.

When a personnel touches the casing 12 or the rod-shaped antenna 21 which are located outside the vehicle, and causes an oscillation of the casing 12 or attempts to dismount the casing 12 from the vehicle against the magnetic attraction of the permanent magnet 17 in order to steal the antenna assembly, such external oscillations cause the ball 36 to roll on the printed circuit substrate 16. In response thereto, the ball 36 will successively open or short-circuit the circuit between the first and the second electrode 34, 35, or between such electrode and the outer or the inner conductor 32, 33. As a consequence, a train of pulses P as shown in FIG. 4 will be developed across the resistor 37, and operate the detector 48. The detector 48 feeds the alarm circuit 49, thus causing the loudspeaker 50 to produce an audible alarm. The personnel who has been tampering with the antenna assembly will be astonished at the audible alarm, leaving the vehicle. The owner or the driver of the vehicle will be alerted by the audible alarm, coming back to the vehicle to confirm the safety of the antenna assembly. The audible alarm can be interrupted by turning the power switch 39 off.

The antenna assembly of the invention is fixedly mounted on the car body by means of the permanent magnet 17, and is operable in response to any oscillations applied to the car body. Hence, the shaking of the vehicle as a man get in and out or any inclination of the car body in an attempt to disassemble the wheels will operate the alarm unit, thus effectively preventing any theft of the vehicle or wheels. If the theft of the antenna assembly or the vehicle is attempted by initially cutting the coaxial cable 27 off, inasmuch as the cable is used to connect the vibration detector and the circuit, the core conductor 28 and the enclosure 29 of the coaxial cable 27 will be short-circuited upon cutting, and a resulting switching pulse developed operates the alarm unit, again causing it to produce an audible alarm.

In the embodiment described above, the first and the second electrode 34, 35 include radially extending fingers, but it should be understood that these fingers may extend parallel to each other or may be staggered. The power switch 39 also serves as a power switch for the radio transceiver. Alternatively, the combination of the power switch 39 and the key switch 43 may be formed by a single double-pole single-throw switch which is mounted on the support member 22.

What is claimed is:

1. An antenna assembly for vehicle radio transceiver, comprising an antenna;

a casing supporting the lower end of the antenna and including an internal space which is enclosed by a top plate, a side plate and a bottomplate;

a magnet mounted on the casing for securing the casing to a body of the vehicle by magnetic attraction;

a vibration detector for detecting any vibration caused to the casing, the detector including a d.c. power supply circuit, a printed circuit board mounted on the bottomplate of the casing, and a conductive spherical body placed on the printed circuit board, the printed circuit board being provided with a first and a second electrode each having a plurality of mutually interdigitated fingers, one of the electrodes being connected to one terminal of the d.c. power supply circuit and the other electrode being connected to the other terminal thereof, the spherical body having a diameter which is sufficient to provide an electrical interconnection between two adjacent fingers of the both electrodes whenever it is located therebetween; and an alarm circuit for producing an audible alarm in response to a change in the voltage which is developed in the d.c. power supply circuit as a result of a movement of the spherical body over the printed circuit board in response to the vibration applied to the casing.

2. An antenna assembly according to claim 1 in which the printed circuit and the d.c. power supply circuit are connected together by one of a pair of conductors in a coaxial cable, the other conductor being connected to the bottomplate of the casing which is formed of a conductive material.

3. An antenna assembly according to claim 1 in which a key switch is provided in the casing and is electrically connected between the printed circuit and the d.c. power supply circuit.

4. An antenna assembly according to claim 1 in which the casing is defined to be cylindrical by the bottomplate and the side plate, while the top cover is conical in configuration, and in which the magnet is annular in configuration and is disposed around the inner peripheral surface of the side plate and in which the first and the second electrode are disposed within a central opening in the magnet.

* * * * *